US010510476B2

(12) United States Patent
Yen et al.

(10) Patent No.: US 10,510,476 B2
(45) Date of Patent: Dec. 17, 2019

(54) SLOW WAVE INDUCTIVE STRUCTURE AND METHOD OF FORMING THE SAME

(71) Applicant: TAIWAN SEMICONDUCTOR MANUFACTURING COMPANY, LTD., Hsinchu (TW)

(72) Inventors: Hsiao-Tsung Yen, Tainan (TW); Cheng-Wei Luo, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 1178 days.

(21) Appl. No.: 14/039,024

(22) Filed: Sep. 27, 2013

(65) Prior Publication Data

US 2015/0091683 A1 Apr. 2, 2015

(51) Int. Cl.
*H01F 5/00* (2006.01)
*H01F 21/12* (2006.01)

(52) U.S. Cl.
CPC ..... *H01F 21/12* (2013.01); *H01F 2021/125* (2013.01)

(58) Field of Classification Search
CPC ..... H01F 21/12
USPC ..... 336/200, 232, 223
See application file for complete search history.

(56) References Cited

U.S. PATENT DOCUMENTS

| | | | | |
|---|---|---|---|---|
| 4,959,631 | A * | 9/1990 | Hasegawa et al. | 336/83 |
| 6,992,366 | B2 * | 1/2006 | Kim et al. | 257/531 |
| 2004/0075523 | A1 * | 4/2004 | Shimazawa et al. | 336/200 |
| 2012/0274434 | A1 * | 11/2012 | Lim et al. | 336/200 |
| 2012/0319237 | A1 * | 12/2012 | Cooney, III | H01L 23/5227 257/531 |

* cited by examiner

*Primary Examiner* — Ronald Hinson
(74) *Attorney, Agent, or Firm* — Hauptman Ham, LLP

(57) ABSTRACT

A slow wave inductive structure includes a first substrate, a first conductive winding over the first substrate, and a second substrate over the first substrate. The second substrate has a thickness ranging from about 50 nanometers (nm) to about 150 nm. A distance between the first conductive winding and the second substrate ranges from about 1 micron (μm) to about 2 μm. A slow wave inductor includes a first substrate and a first conductive winding over the first substrate. The slow wave inductor further includes a second substrate over the first substrate and a plurality of switches in the second conductive substrate. The first conductive winding is connected to each switch of the plurality of switches.

17 Claims, 8 Drawing Sheets

SLOW WAVE INDUCTIVE STRUCTURE AND METHOD OF FORMING THE SAME

BACKGROUND

Inductors are used in circuits to help regulate current flow through the circuit. When a current flows through the inductor, energy is stored temporarily in a magnetic field in the inductor. When the current flowing through the inductor changes, a time-varying magnetic field within the inductor induces a voltage in the inductor which opposes the change in current that created the magnetic field.

A transformer is a static electrical device that transfers energy by inductive coupling between winding circuits. A varying current in a primary winding creates a varying magnetic flux in a core of the transformer and varies a magnetic flux through a secondary winding. The varying magnetic flux induces a varying voltage in the secondary winding.

As technology nodes shrink, circuit sizes are reduced. Inductors or transformers occupy a large area in a circuit design. As the circuit size decreases, proximity between the inductor or transformer and the other devices increases. Further, as metal lines in these components decrease in size, a resistance in the metal lines increases. The increased resistance in turn lowers the quality (Q) factor of the inductors and transformers. In addition, inductors and transformers cause a magnetic flux to pass through the circuit. The magnetic flux is capable of introducing noise into other devices within the circuit.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1A:
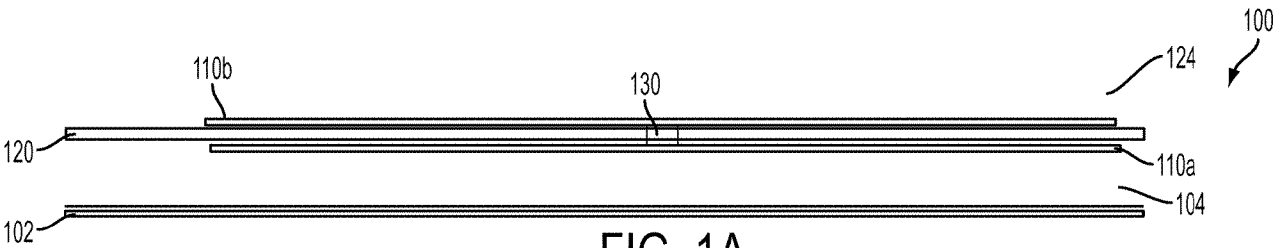
FIG. 1A is a cross sectional view of a slow wave inductive structure in accordance with one or more embodiments.

FIG. 1A is a cross sectional view of a slow wave inductive structure 100 in accordance with one or more embodiments. Slow wave inductive structure 100 includes a first substrate 102 and a first inter-metal dielectric (IMD) layer 104 over the first substrate. Slow wave inductive structure 100 includes a first conductive winding 110*a* in first IMD layer 104. A second substrate 120 is over first IMD layer 104 and over first conductive winding 110*a*. A second IMD layer 124 is over second substrate 120. A second conductive winding 110*b* is in second IMD layer 124. A conductive line 130 electrically connects first conductive winding 110*a* to second inductive winding 110*b* through second substrate 120.

In some embodiments, first substrate 102 includes an elementary semiconductor including silicon or germanium in crystal, polycrystalline, or an amorphous structure; a compound semiconductor including silicon carbide, gallium arsenic, gallium phosphide, indium phosphide, indium arsenide, and indium antimonide; an alloy semiconductor including SiGe, GaAsP, AlInAs, AlGaAs, GaInAs, GaInP, and GaInAsP; any other suitable material; or combinations thereof. In some embodiments, the alloy semiconductor substrate has a gradient SiGe feature in which the Si and Ge composition change from one ratio at one location to another ratio at another location of the gradient SiGe feature. In some embodiments, the alloy SiGe is formed over a silicon substrate. In some embodiments, first substrate 102 is a strained SiGe substrate. In some embodiments, the semiconductor substrate has a semiconductor on insulator structure, such as a silicon on insulator (SOI) structure. In some embodiments, the semiconductor substrate includes a doped epi layer or a buried layer. In some embodiments, the compound semiconductor substrate has a multilayer structure, or the substrate includes a multilayer compound semiconductor structure. In some embodiments, a thickness of first substrate ranges from about 30 microns (μm) to about 50 μm.

First IMD layer 104 is a multi-layer material having conductive lines extending in a plane parallel to a top surface of first substrate 102 in each layer and conductive vias connecting conductive lines on separate layers in the first IMD layer. First IMD layer 104 includes a dielectric material configured to insulate the conductive lines and conductive vias. In some embodiments, first IMD layer 104 includes an interconnect structure configured to electrically connect active devices in or on first substrate 102. In some embodiments, the dielectric material of first IMD layer 102 includes a low-k dielectric material. A low-k dielectric material has a dielectric constant less than that of silicon dioxide.

First conductive winding 110*a* includes conductive lines in first IMD layer 104. In some embodiments, first conductive winding 110*a* is in a two-dimensional plane in first IMD layer 104. In some embodiments, first conductive winding

110*a* is a three-dimensional structure in first IMD layer 104. The three-dimensional structure includes a combination of conductive lines on different layers of first IMD layer 104 and conductive vias connecting the conductive lines. In some embodiments, first conductive winding 110*a* includes a single port for either receiving or outputting an electrical current. In some embodiments, first conductive winding 110*a* includes more than one port and is capable of both receiving and outputting an electrical current. In some embodiments, first conductive winding 110*a* includes copper, aluminum, nickel, tungsten, titanium, or another suitable conductive material. In some embodiments, first conductive winding is omitted and slow wave inductive structure 100 includes only second conductive winding 110*b*.

In some embodiments, first conductive winding 110*a* is a meandering type winding in which a conductive line extends along an angled direction with respect to an x-axis and a y-axis of first IMD layer 104. Conductive lines in a same layer of first IMD layer 104 extend parallel to one another. Conductive lines in a different layer of first IMD layer 104 are arranged to allow electrical connection between the parallel conductive lines; and conductive vias connect the conductive lines on the different layers of the first IMD layer.

In some embodiments, first conductive winding 110*a* is a spiral type winding in which conductive lines are arranged in a spiral arrangement in different layers of first IMD layer 104. Conductive vias provide electrical connections between the conductive lines in the different layers of first IMD layer 104.

Second substrate 120 is used to reduce a speed of a current through first conductive winding 110*a* or second conductive winding 110*b*. Second substrate 120 is capable of reducing the speed of the current through first conductive winding 110*a* or second conductive winding 110*b* due to the conductivity of the second substrate. A magnetic field generated by passing the current through first conductive winding 110*a* or second conductive winding 110*b* induces a current within second substrate 120 which slows the propagation of waves through the first conductive winding or the second conductive winding. In some embodiments, second substrate 120 includes polysilicon, doped silicon, or other suitable conductive materials.

In some embodiments, a thickness of second substrate 120 ranges from about 50 nanometers (nm) to about 150 nm. In some embodiments, the thickness of second substrate 120 ranges from about 150 nanometers (nm) to about 450 nm. In some embodiments, the thickness of second substrate 120 ranges from about 450 nanometers (nm) to about 850 nm. If the thickness of second substrate 120 is too great, forming conductive line 130 becomes difficult and the length of the ILV unnecessarily increases resistance in slow wave inductive structure 100, in some embodiments. If the thickness of second substrate 120 is too small, the second substrate does not sufficiently reduce the speed of the wave propagating through first conductive winding 110*a* or second conductive winding 110*b*, in some embodiments.

In some embodiments, a separation between first conductive winding 110*a* and second substrate 120 ranges from about 500 nm to about 1 μm. In some embodiments, the separation between first conductive winding 110*a* and second substrate 120 ranges from about 1 μm to about 2 μm. In some embodiments, the separation between first conductive winding 110*a* and second substrate 120 ranges from about 2 μm to about 5 μm. In some embodiments, the separation between first conductive winding 110*a* and second substrate 120 ranges from about 5 μm to about 15 μm. If the separation is too great, the magnetic field generated by passing current through first conductive winding 110*a* is too weak to generate the current in second substrate 120 to slow the propagation of the wave in the first conductive winding, in some embodiments. If the separation is too small, first IMD layer 104 is not able to provide sufficient insulation between first conductive winding 110*a* and second substrate 120, in some embodiments.

By slowing the propagation of the wave through first conductive winding 110*a* or second conductive winding 110*b*, an inductance strength of slow wave inductive structure 100 is increased without increasing a size of the first conductive winding or the second conductive winding. In comparison with an arrangement which does not include second substrate 120, slow wave inductive structure 100 provides a same inductance while occupying a smaller area in the circuit. The smaller area helps to facilitate reducing an overall size of the circuit.

Second IMD layer 124 includes a dielectric material and conductive lines and conductive vias. Second IMD layer 124 is a multi-layer material having conductive lines extending in a plane parallel to a top surface of second substrate 120 in each layer and conductive vias connecting conductive lines on separate layers in the first IMD layer. In some embodiments, second IMD layer 124 includes an interconnect structure configured to electrically connect active devices in or on second substrate 120. The dielectric material in second IMD layer 124 is used to provide insulation between adjacent conductive lines or conductive vias. In some embodiments, the dielectric material of second IMD layer 124 includes a low-k dielectric material. In some embodiments, the dielectric material of second IMD layer 124 is a same dielectric material as first IMD layer 104. In some embodiments, the dielectric material of second IMD layer 124 is different from the dielectric material of first IMD layer 104.

In some embodiments, a separation between second conductive winding 110*b* and second substrate 120 ranges from about 1 μm to about 2 μm. If the separation is too great, the magnetic field generated by passing current through second conductive winding 110*b* is too weak to generate the current in second substrate 120 to slow the propagation of the wave in the second conductive winding, in some embodiments. If the separation is too small, second IMD layer 124 is not able to provide sufficient insulation between second conductive winding 110*b* and second substrate 120, in some embodiments. In some embodiments, the separation between first conductive winding 110*a* and second substrate 120 is equal to the separation between second conductive winding 110*b* and the second substrate. In some embodiments, the separation between first conductive winding 110*a* and second substrate 120 is different from the separation between second conductive winding 110*b* and the second substrate.

Second conductive winding 110*b* includes conductive lines in second IMD layer 124. In some embodiments, second conductive winding 110*b* is in a two-dimensional plane in second IMD layer 124. In some embodiments, second conductive winding 110*b* is a three-dimensional structure in second IMD layer 124. In some embodiments, second conductive winding 110*b* includes a single port for either receiving or outputting an electrical current. In some embodiments, second conductive winding 110*b* includes more than one port and is capable of both receiving and outputting an electrical current. In some embodiments, second conductive winding 110*b* includes copper, aluminum, nickel, tungsten, titanium, or another suitable conductive material. In some embodiments, second conductive winding 110*b* is omitted and slow wave inductive structure 100 includes only first conductive winding 110*a*. In some embodiments, a shape of second conductive winding 110*b* is a same shape as first conductive winding 110*a*. In some embodiments, the shape of second conductive winding is different from first conductive winding 110*a*.

Conductive line 130 is used to electrically connect first conductive winding 110*a* to second conductive winding 110*b*. Conductive line 130 extends through second substrate 120. In some embodiments, conductive line 130 is a metal line, a via, a through silicon via (TSV), an inter-level via (ILV), or another suitable conductive line. In some embodiments, conductive line 130 includes copper, aluminum, nickel, titanium, tungsten or other suitable conductive material. In some embodiments, conductive line 130 is a same material as first conductive winding 110*a* and second conductive winding 110*b*. In some embodiments, conductive line 130 is a different material from first conductive winding 110*a* or second conductive material 110*b*. In some embodiments where slow wave inductive structure 100 is a transformer, conductive line 130 is omitted to prevent direct electrical connection between first conductive winding 110*a* and second conductive winding 110*b*.

Figure 1B:
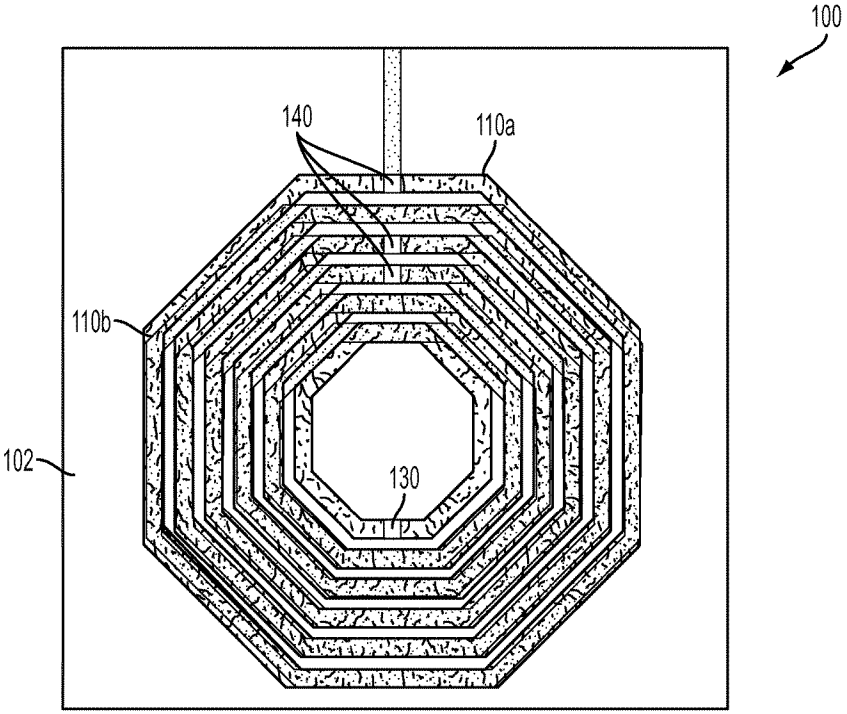
FIG. 1B is a top view of a slow wave inductive structure in accordance with one or more embodiments.

FIG. 1B is a top view of slow wave inductive structure 100 in accordance with one or more embodiments. The top view includes switches 140 which are formed in second substrate 120 to selective connect different portions of first conductive winding 110*a* and second conductive winding 110*b*. In some embodiments, switches 140 are transistors, such as metal-oxide-semiconductor (MOS) transistors, bipolar junction transistors (BJTs), high electron mobility transistors (HEMTs), or other suitable switching elements. By independently activating switches 140, an inductance and Q factor of slow wave inductive structure 100 is adjustable. In some embodiments, switches 140 are activated based on control signals received from a controller. In some embodiments, the control signals are generated in response to a user input. In some embodiments, the control signals are generated automatically in response to a detected current change. In some embodiments in which switches 140 are transistors, the control signal is applied to a gate of the switch to selectively active the switch.

Figure 2B:
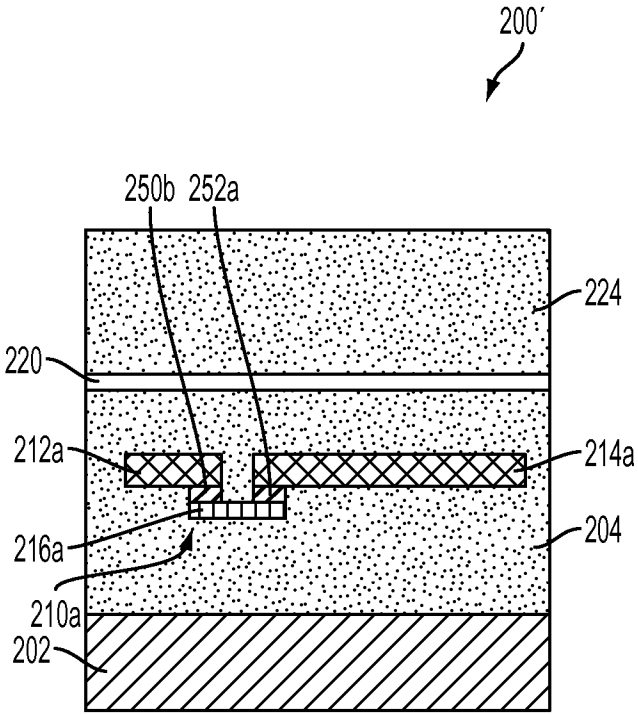
FIG. 2B is a cross sectional view of a slow wave inductor in accordance with one or more embodiments.
Figure 2A:
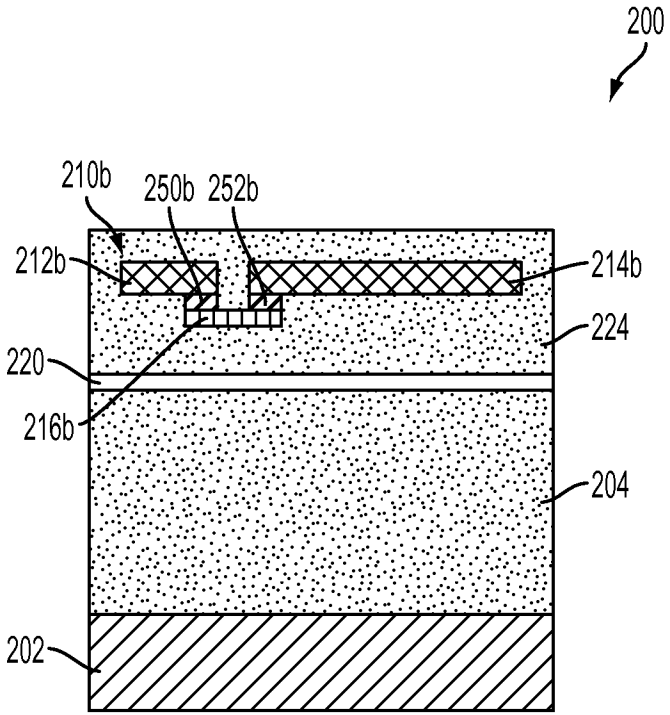
FIG. 2A is a cross sectional view of a slow wave inductor in accordance with one or more embodiments.

FIG. 2A is a cross sectional view of a slow wave inductor 200 in accordance with one or more embodiments. Slow wave inductor 200 is similar to slow wave inductive structure 100 (FIG. 1A). Similar elements have a same reference number increased by 100. Slow wave inductor 200 includes conductive winding 210*b* only in second IMD layer 224. The presence of second substrate 220 helps to slow a propagation of a wave through conductive winding 210*b*. In comparison with approaches which do not include second substrate 220, a size of conductive winding 210*b* is reduced while strength of inductance is maintained. In some embodiments, a separation between conductive winding 210*b* and second substrate 220 ranges from about 1 μm to about 2 μm.

Conductive winding 210*b* includes a first conductive line 212*b* and a second conductive line 214*b* on a same level of second IMD layer 224. Conductive winding 210*b* further includes a third conductive line 216*b* on a different level of second IMD layer 224. Conductive winding 210*b* further includes a first conductive via 250*b* connecting first conductive line 212*b* to third conductive line 216*b*; and a second conductive via 252*b* connecting second conductive line 214*b* to third conductive line 216*b*.

FIG. 2B is a cross sectional view of a slow wave inductor 200' in accordance with one or more embodiments. Slow wave inductor 200' is similar to slow wave inductive structure 100 (FIG. 1A). Similar elements have a same reference number increased by 100. In comparison with slow wave inductor 200 (FIG. 2A), slow wave inductor 200' includes a conductive winding 210*a* only in a first IMD layer 204. In some embodiments, a separation between conductive winding 210*a* and second substrate 220 ranges from about 1 μm to about 2 μm.

Figure 3B:
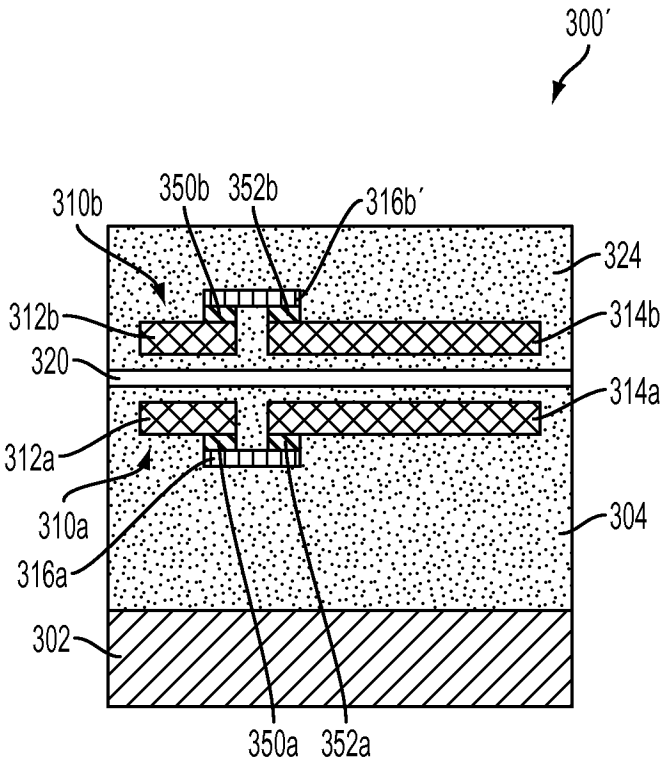
FIG. 3B is a cross sectional view of a slow wave transformer in accordance with one or more embodiments.
Figure 3A:
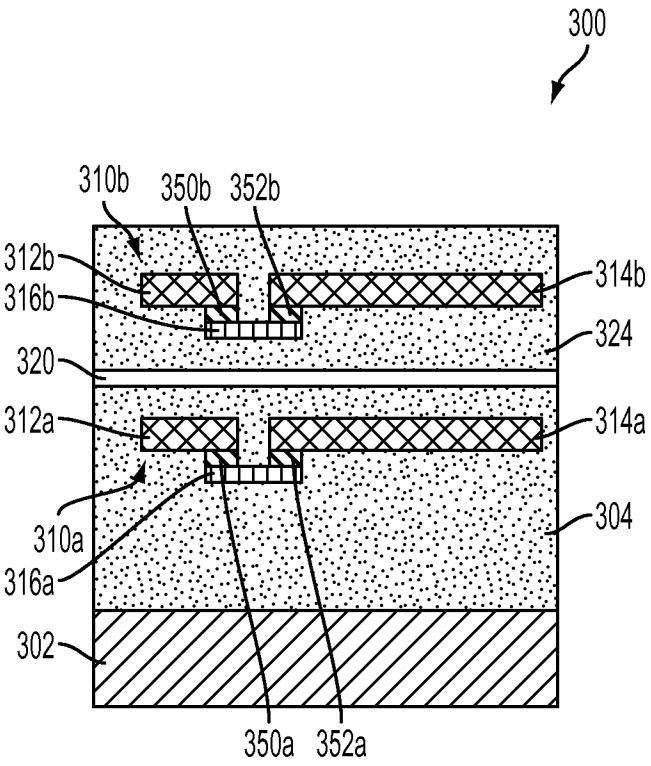
FIG. 3A is a cross sectional view of a slow wave transformer in accordance with one or more embodiments.

FIG. 3A is a cross sectional view of a slow wave transformer 300 in accordance with one or more embodiments. Slow wave transformer 300 is similar to slow wave inductive structure 100 (FIG. 1A). Similar elements have a same reference number increased by 200. Slow wave transformer 300 does not include ILVs providing electrical connections between a first conductive winding 310*a* and a second conductive winding 310*b*. The presence of a second substrate 320 helps to slow a propagation of a wave through first conductive winding 310*a* and second conductive winding 310*b*. In comparison with approaches which do not include second substrate 320, a size of first conductive winding 310*a* and second conductive winding 310*b* is reduced while strength of inductance is maintained. In some embodiments, a separation between first conductive winding 310*a* and second substrate 320 ranges from about 1 μm to about 2 μm. In some embodiments, a separation between second conductive winding 310*b* and second substrate 320 ranges from about 1 μm to about 2 μm. In some embodiments, the separation between second conductive winding 310*b* and second substrate 320 is equal to the separation between first conductive winding 310*a* and the second substrate. In some embodiments, the separation between second conductive winding 310*b* and second substrate 320 is different from the separation between first conductive winding 310*a* and the second substrate.

First conductive winding 310*a* includes a first conductive line 312*a* and a second conductive line 314*a* on a same level of first IMD layer 304. First conductive winding 310*a* further includes a third conductive line 316*a* on a different level of first IMD layer 304. First conductive winding 310*a* further includes a first conductive via 350*a* connecting first conductive line 312*a* to third conductive line 316*a*; and a second conductive via 352*a* connecting second conductive line 314*a* to third conductive line 316*a*.

Second conductive winding 310*b* includes a first conductive line 312*b* and a second conductive line 312*b* on a same level of second IMD layer 324. Second conductive winding 310*b* further includes a third conductive line 316*b* on a different level of second IMD layer 324. Second conductive winding 310*b* further includes a first conductive via 350*b* connecting first conductive line 312*b* to third conductive line 316*b*; and a second conductive via 352*b* connecting second conductive line 314*b* to third conductive line 316*b*. In the arrangement of slow wave transformer 300, third conductive line 316*b* is closer to second substrate 320 than first conductive line 312*b* and second conductive line 314*b*.

FIG. 3B is a cross sectional view of a slow wave transformer 300' in accordance with one or more embodiments. Slow wave transformer 300' is similar to slow wave inductive structure 100 (FIG. 1A). Similar elements have a same reference number increased by 200. In comparison with slow wave transformer 300 (FIG. 3A), slow wave transformer 300' includes a third conductive line 316*b'* of second conductive winding 310*b* farther from second substrate 320 than first conductive line 312*b* and second conductive line 314*b* of the second conductive winding.

Figure 4:
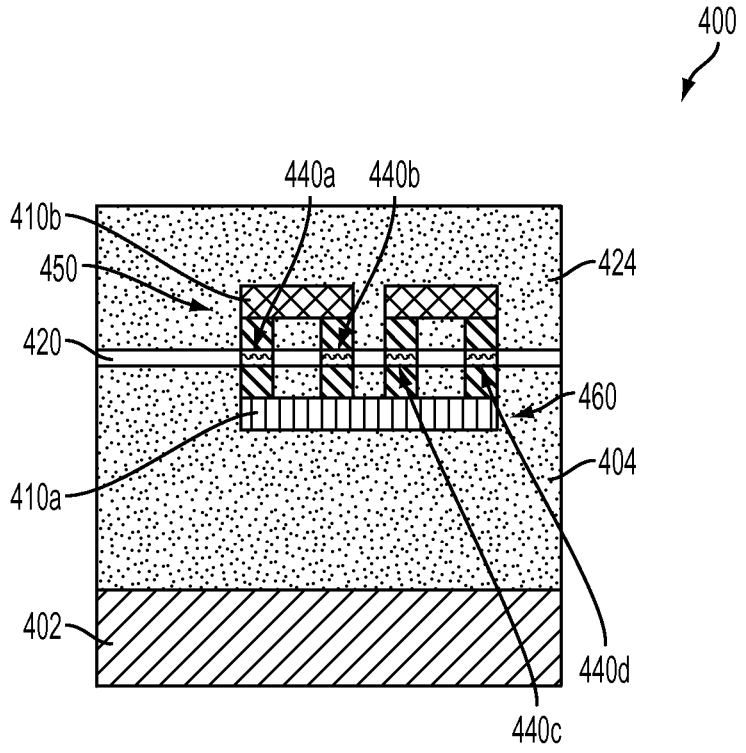
FIG. 4 is a cross sectional view of a slow wave inductor having variable inductance in accordance with one or more embodiments.

FIG. 4 is a cross sectional view of a slow wave inductor 400 having variable inductance in accordance with one or more embodiments. Slow wave inductor 400 is similar to slow wave inductive structure 100 (FIG. 1A). Similar elements have a same reference number increased by 300. Slow wave inductor 400 includes an input port 450 configured to receive an electrical current. Slow wave inductor 400 includes an output port 460 configured to output an electrical current. Slow wave inductor 400 includes a first conductive line connected to input port 450 and a second conductive line connected to output port 460. A first conductive element and a second conductive element selectively connect the first conductive line to the second conductive line. In some embodiments, the first conductive element and the second conductive element are independently selected from metal lines, via, TSVs, ILVs, or other suitable conductive elements. Slow wave inductor 400 further includes a third conductive line in second IMD layer 424. A third conductive element and a fourth conductive element selectively connect the third conductive line to the second conductive line. In some embodiments, the third conductive element and the fourth conductive element are independently selected from metal lines, via, TSVs, ILVs, or other suitable conductive elements. Slow wave inductor 400 includes four switches 440*a*-440*d* in second substrate 420. Switch 440*a* is configured to selectively allow electrical connection between the first conductive line and the second conductive line along the first conductive element. Switch 440*b* is configured to selectively allow electrical connection between the first conductive line and the second conductive line along the second conductive element. Switch 440*c* is configured to selectively allow electrical connection between the third conductive line and the second conductive line along the third conductive element. Switch 440*d* is configured to selectively allow electrical connection between the third conductive line and the second conductive line along the fourth conductive element. In some embodiments, slow wave inductor 400 includes more or less than four switches.

By independently activating switches 440*a*-440*d*, a current path through slow wave inductor 400 is adjusted, which facilitates adjusting of an inductance and a Q factor of the slow wave inductor. FIGS. 5A-5E are cross sectional view of current paths of slow wave inductor 400 having variable inductance in accordance with one or more embodiments.

Figure 5A:
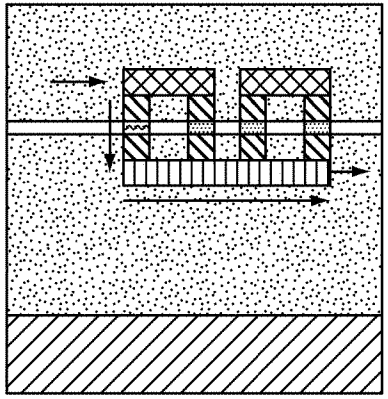
FIGS. 5A-5E are cross sectional view of current paths of a slow wave inductor having variable inductance in accordance with one or more embodiments.

In FIG. 5A, switch 440*a* is activated permitting a current path from input port 450 through the first conductive element to output port 460.

Figure 5B:
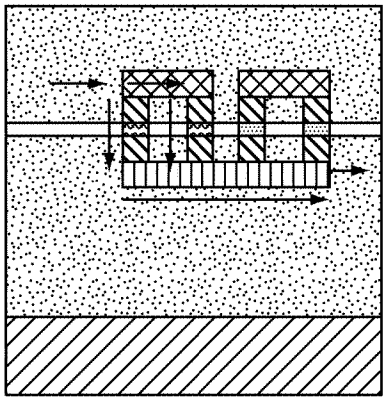

In FIG. 5B, switches 440*a* and 440*b* are activated permitting a current path from input port 450 through the first conductive element and the second conductive element to output port 460.

Figure 5C:
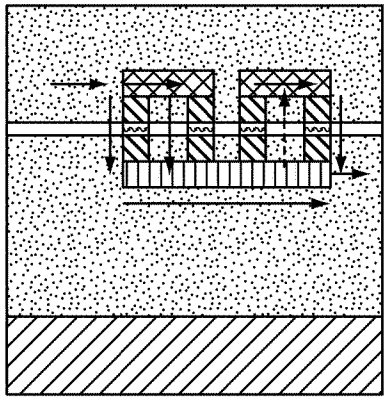

In FIG. 5C, switches 440*a*-440*d* are activated permitting a current path from input port 450 through each of the first through fourth conductive elements to output port 460. Current traveling along third conductive element through switch 440*c* creates a negative mutual inductance within slow wave inductor 400. The negative mutual inductance is produced by a magnetic flux generated by current traveling in opposite directions through the third conductive element in comparison with the first conductive element, the second conductive element and the fourth conductive element. Negative mutual inductance reduces an overall inductance of slow wave inductor 400.

Figure 5D:
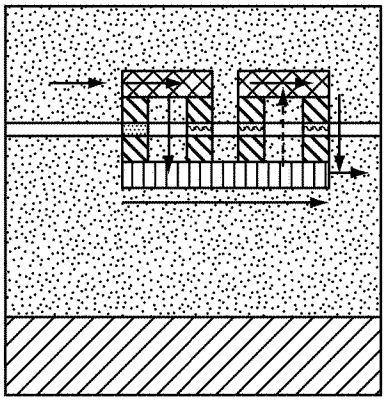

In FIG. 5D, switches 440*b*-440*d* are activated permitting a current path from input port 450 through the second conductive element, the third conductive element, and the fourth conductive element to output port 460. Current traveling along third conductive element through switch 440*c* creates negative mutual inductance within slow wave inductor 400.

Figure 5E:
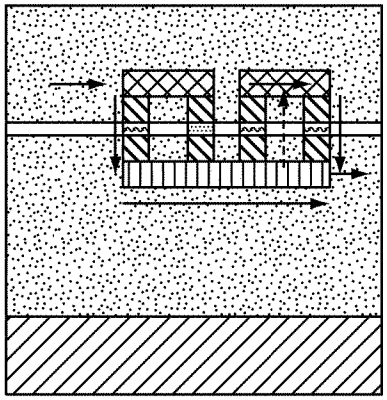

In FIG. 5E, switches 440*a*, 440*c* and 440*d* are activated permitting a current path from input port 450 through the first conductive element, the third conductive element, and the fourth conductive element to output port 460. Current traveling along third conductive element through switch 440*c* creates negative mutual inductance within slow wave inductor 400.

In embodiments where only one of switch 440*c* or switch 440*d* is activated, slow wave inductor 400 would include an open stub. An open stub is a conductive line which has an inlet but no outlet. In embodiments, where only one of switch 440*c* or switch 440*d* is activated, slow wave inductor 400 would operate similar to a band stop filter by trapping a frequency of the input frequency in the open stub. The frequency trapped in the open stub is based on a length of the open stub.

Figure 6:
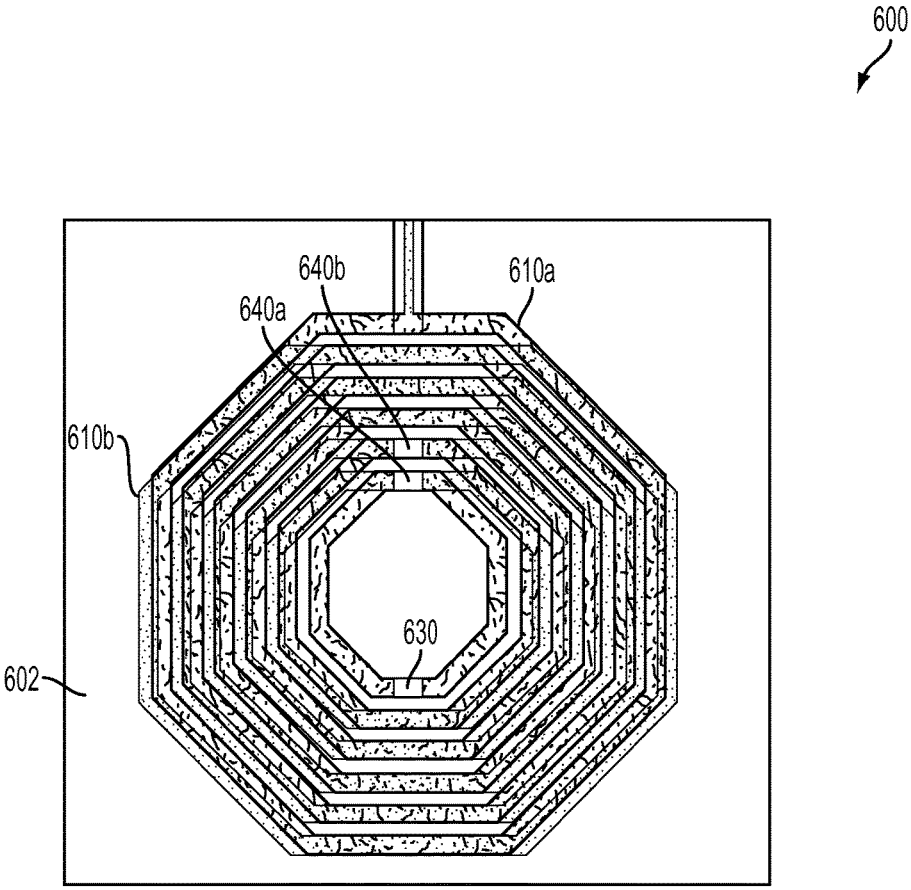
FIG. 6 is a top view of a slow wave inductor having a variable inductance in accordance with one or more embodiments.

FIG. 6 is a top view of a slow wave inductor 600 having a variable inductance in accordance with one or more embodiments. Slow wave inductor 600 is similar to slow wave inductive structure 100 (FIG. 1). Similar elements have a same reference number increased by 500. In comparison with slow wave inductive structure 100, slow wave inductor 600 includes a first switch 640*a*, and a second switch 640*b*, which are configured to selectively connect portions of first conductive winding 610*a* and second conductive winding 610*b*. In some embodiments, slow wave inductor 600 includes more or less than two switches. In some embodiments, a number of switches and a location of the switches are selected based on performance characteristics of slow wave inductor 600. In some embodiments, the performance characteristics are determined using empirical data. In some embodiments, the performance characteristics are determined using simulation data.

Figure 7B:
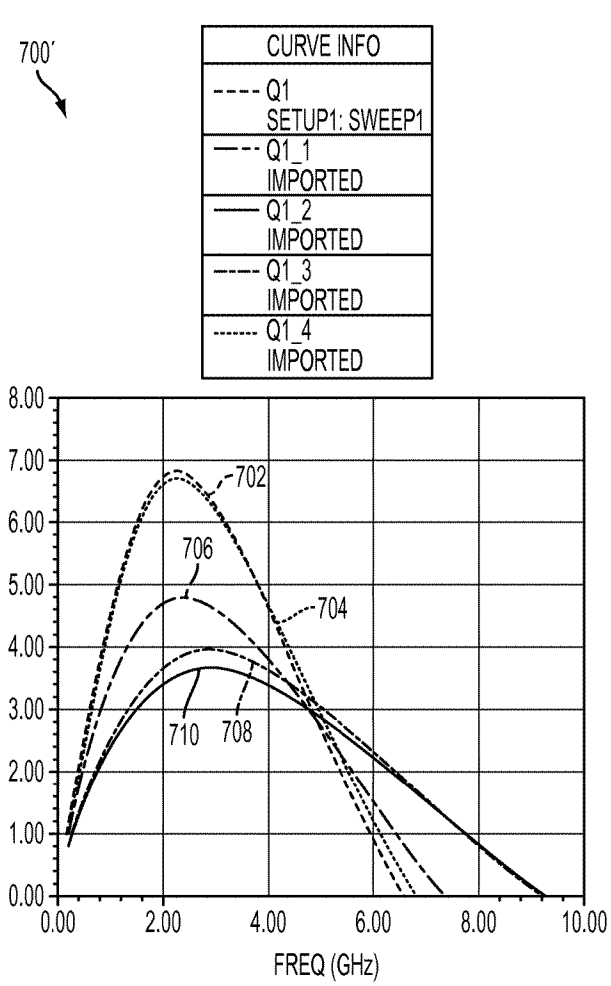
FIG. 7B is a graph of Q factor versus frequency for various switching arrangements of the slow wave inductor of FIG. 6 in accordance with one or more embodiments.
Figure 7A:
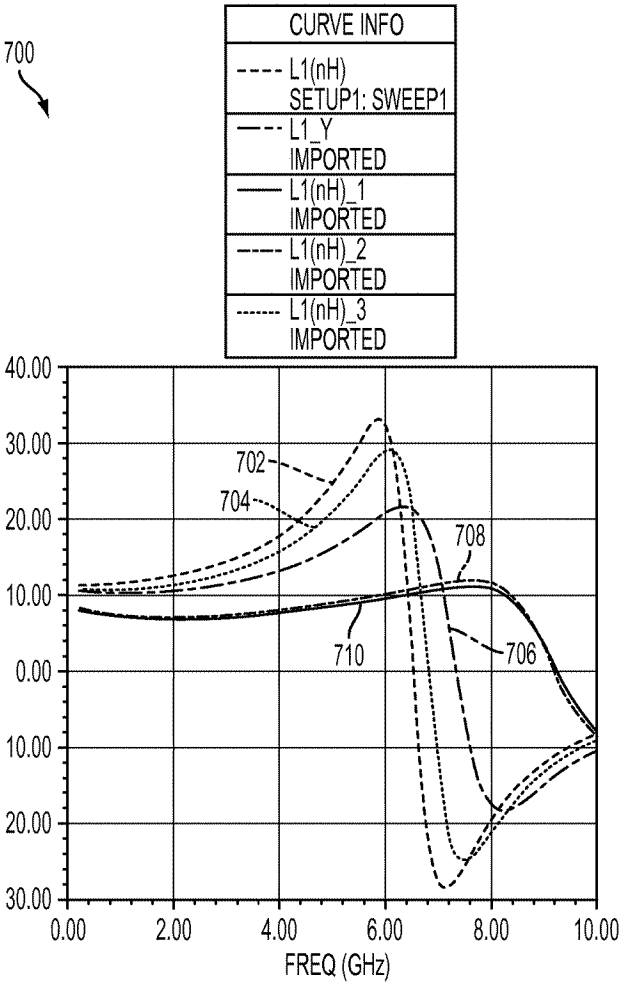
FIG. 7A is a graph of inductance versus frequency for various switching arrangements of the slow wave inductor of FIG. 6 in accordance with one or more embodiments.

FIG. 7A is a graph 700 of inductance versus input frequency for various switching arrangements of slow wave inductor 600 in accordance with one or more embodiments. FIG. 7B is a graph 700' of Q factor versus input frequency for various switching arrangements of slow wave inductor 600 in accordance with one or more embodiments. Graph 700 and graph 700' include a plot 702 in which switch 640*a* is activated and switches 640*b* and 640*c* are deactivated. Graph 700 and graph 700' include a plot 704 in which switch 640*b* is activated and switches 640*a* and 640*c* are deactivated. Graph 700 and graph 700' include a plot 706 in which switches 640*a* and 640*b* are activated and switch 640*c* is deactivated. Graph 700 and graph 700' include a plot 708 in which switches 640*a* and 640*c* are activated and switch 640*b* is deactivated. Graph 700 and graph 700' include a plot 710 in which switches 640*a*, 640*b* and 640*c* are activated.

Different current paths through slow wave inductor 600 provide different levels of inductance, as indicated in graph 700. Inductance is a resistance to a change in current. Graph 700 indicates that plots 702 and 704 provide significant variation in the inductance with respect to an input frequency. Plots 708 and 710, however, indicate a low variation in inductance with respect to the input frequency. Plot 706 indicates a moderate variation in inductance with respect to the input frequency.

Different current paths through slow wave inductor 600 provide different Q factors, as indicated in graph 700'. Q factor is a measure of how efficient an inductor operates. Graph 700' indicates that plots 702 and 704 have a high Q factor in a frequency range from about 1.5 gigaHertz (GHz) to about 4 GHz. Plots 708 and 710, however, indicate an overall low Q factor. Plot 706 indicates a moderate Q factor in a frequency range from about 1.5 GHz to about 4 GHz, but not as high as plots 702 and 704. The inventor believes the difference in Q factor between plot 706 and plots 702 and 704 indicates a portion of slow wave inductor 600 does not provide a significant contribution to the inductance of the slow wave inductor, so passing current through this portion reduces the efficiency of slow wave inductor 600.

Figure 8:
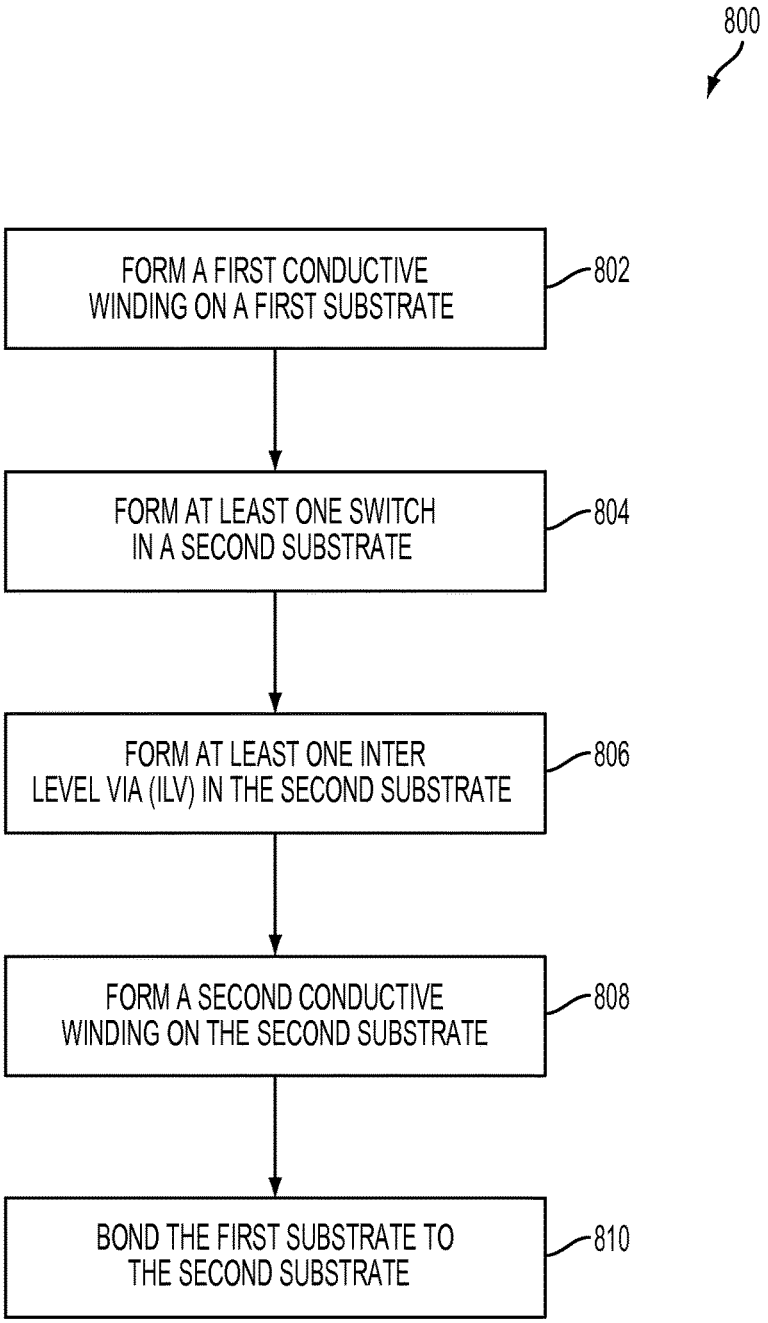
FIG. 8 is a flow chart of a method of making a slow wave inductive structure in accordance with one or more embodiments.

FIG. 8 is a flow chart of a method 800 of making a slow wave inductive structure in accordance with one or more embodiments. Method 800 begins with operation 802 in which a first conductive winding, e.g., first conductive winding 110*a* (FIG. 1A), is formed on a first substrate, e.g., first substrate 102. In some embodiments, the first conductive winding is formed using a combination of photolithography and etching processes to form openings in an IMD layer, e.g., first IMD layer 104. In some embodiments, the photolithography process includes patterning a photoresist, such as a positive photoresist or a negative photoresist. In some embodiments, the photolithography process includes forming a hard mask, an antireflective structure, or another suitable photolithography structure. In some embodiments, the etching process is a wet etching process, a dry etching process, a reactive ion etching (RIE) process, or another suitable etching process. The openings are then filled with conductive material, e.g., copper, aluminum, titanium, nickel, tungsten, or other suitable conductive material. In some embodiments, the openings are filled using chemical vapor deposition (CVD), physical vapor deposition (PVD), sputtering, atomic layer deposition (ALD) or other suitable formation process.

In some embodiments, operation 802 is omitted. Operation 802 is omitted in embodiments which do not include a conductive winding between the first substrate and a second substrate, e.g., slow wave inductor 200 (FIG. 2A).

Method 800 continues with operation 804 in which at least one switch, e.g., switches 140 (FIG. 1A), is formed in the second substrate, e.g., second substrate 120. In some embodiments, the at least one switch is a MOS, BJT, HEMT or another suitable switching element. In some embodiments, the at least on switch is formed through a combination of implantation processes, deposition process and etching processes. In some embodiments, operation 804 is omitted. Operation 804 is omitted in embodiments in which the slow wave inductive structure is a transformer, e.g., slow wave transformer 300 (FIG. 3A); in embodiments where the conductive winding is formed on only one side of the second substrate, e.g., slow wave inductor 200 (FIG. 2A); or in embodiments where slow wave inductor does not include a variable inductance.

Method 800 continues with operation 806 in which at least one conductive line, e.g., conductive line 130 (FIG. 1A), is formed in the second substrate. In some embodiments, the conductive line is formed using a combination of photolithography and etching processes to form openings in the second substrate. In some embodiments, the photolithography process includes patterning a photoresist, such as a positive photoresist or a negative photoresist. In some embodiments, the photolithography process includes forming a hard mask, an antireflective structure, or another suitable photolithography structure. In some embodiments, the etching process is a wet etching process, a dry etching process, an RIE process, or another suitable etching process. The openings are then filled with conductive material, e.g., copper, aluminum, titanium, nickel, tungsten, or other suitable conductive material. In some embodiments, the openings are filled using chemical vapor deposition (CVD), physical vapor deposition (PVD), sputtering, atomic layer deposition (ALD) or other suitable formation process.

In some embodiments, operation 806 is omitted. Operation 806 is omitted in embodiments in which the slow wave inductive structure is a transformer, e.g., slow wave transformer 300 (FIG. 3A); or in embodiments where the conductive winding is formed on only one side of the second substrate, e.g., slow wave inductor 200 (FIG. 2A).

Method 800 continues with operation 808 in which a second conductive winding, e.g., second conductive winding 110*b* (FIG. 1A), is formed in the second substrate. In some embodiments, the second conductive winding is formed using a combination of photolithography and etching processes to form openings in an IMD layer, e.g., second IMD layer 124. In some embodiments, the photolithography process includes patterning a photoresist, such as a positive photoresist or a negative photoresist. In some embodiments, the photolithography process includes forming a hard mask, an antireflective structure, or another suitable photolithography structure. In some embodiments, the etching process is a wet etching process, a dry etching process, an RIE process, or another suitable etching process. The openings are then filled with conductive material, e.g., copper, aluminum, titanium, nickel, tungsten, or other suitable conductive material. In some embodiments, the openings are filled using chemical vapor deposition (CVD), physical vapor deposition (PVD), sputtering, atomic layer deposition (ALD) or other suitable formation process.

In some embodiments, operation 808 is omitted. Operation 808 is omitted in embodiments which include a conductive winding only between the first substrate and a second substrate, e.g., slow wave inductor 200' (FIG. 2B).

Method 800 continues with operation 810 in which the first substrate is bonded to the second substrate. In some embodiments, the first substrate is bonded to the second substrate using a laser bonding process, a conductive adhesive layer, soldering process or another suitable bonding process.

One of ordinary skill in the art would recognize that an order of operations in method 800 is adjustable. One of ordinary skill in the art would further recognize that additional steps are able to be included in method 800 without departing from the scope of this description.

One aspect of this description relates to a slow wave inductive structure. The slow wave inductive structure includes a first substrate, a first conductive winding over the first substrate, and a second substrate over the first substrate. The second substrate has a thickness ranging from about 50 nanometers (nm) to about 150 nm. A distance between the first conductive winding and the second substrate ranges from about 1 micron (μm) to about 2 μm.

Another aspect of this description relates to a slow wave inductor. The slow wave inductor includes a first substrate and a first conductive winding over the first substrate. The slow wave inductor further includes a second substrate over the first substrate and a plurality of switches in the second conductive substrate. The first conductive winding is connected to each switch of the plurality of switches.

Still another aspect of this description relates to a method of making a slow wave inductive structure. The method includes forming a first conductive winding over a first substrate and bonding a second substrate to the first substrate. The second substrate has a thickness ranging from about 50 nanometers (nm) to about 150 nm. A distance between the first conductive winding and the second substrate ranges from about 1 micron (μm) to about 2 μm.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A slow wave inductive structure comprising: a first substrate;

a first conductive winding over the first substrate; and a second substrate over the first substrate, the second substrate having a thickness ranging from about 50 nanometers (nm) to about 150 nm, wherein a distance between the first conductive winding and the second substrate ranges from about 1 micron (μm) to about 2 μm, wherein a second conductive winding on an opposite side of the second substrate from the first conductive winding and the second substrate comprises polysilicon or doped silicon.

2. The slow wave inductive structure of claim 1, wherein the first conductive winding is between the first substrate and the second substrate.

3. The slow wave inductive structure of claim 1, wherein a distance from the second conductive winding to the second substrate ranges from about 1 μm to about 2 μm.

4. The slow wave inductive structure of claim 1, further comprising an inter level via (ILV) configured to electrically connect the first conductive winding to the second conductive winding through the second substrate.

5. The slow wave inductive structure of claim 1, further comprising at least one switch in the second substrate, wherein the at least one switch is configured to selectively connect the first conductive winding to the second conductive winding.

6. The slow wave inductive structure of claim 1, wherein the first conductive winding is electrically disconnected from the second conductive winding.

7. The slow wave inductive structure of claim 1, further comprising:

a first inter metal dielectric (IMD) layer between the first substrate and the second substrate; and a second IMD layer over the second substrate, wherein the first conductive winding is in the first IMD layer or the second IMD layer.

8. A slow wave inductor comprising:

a first substrate;

a first conductive winding over the first substrate;

a second substrate over the first substrate, wherein a distance between the first conductive winding and the second substrate ranges from about 1 micron (μm) to about 2 μm; and a plurality of switches in the second substrate, wherein the first conductive winding is connected to at least one switch of the plurality of switches.

9. The slow wave inductor of claim 8, wherein the second substrate having a thickness ranging from about 50 nanometers (nm) to about 150 nm.

10. The slow wave inductor of claim 8, further comprising a second conductive winding on an opposite side of the second substrate from the first conductive winding, wherein the second conductive winding is connected to each switch of the plurality of switches.

11. The slow wave inductor of claim 10, wherein at least one switch of the plurality of switches is configured to introduce a negative mutual inductance in the slow wave inductor.

12. The slow wave inductor of claim 10, wherein the second conductive winding comprises an input port, the first conductive winding comprises an output port, and at least one switch of the plurality of switches is configured to allow a current to pass from the input port to the output port.

13. The slow wave inductor of claim 10, further comprising an inter level via (ILV) configured to electrically connect the first conductive winding to the second conductive winding.

14. A slow wave inductive structure comprising:

a first substrate;

a first conductive winding over the first substrate;

a second substrate over the first substrate, the second substrate having a thickness ranging from about 50 nanometers (nm) to about 150 nm; and a second conductive winding over the second substrate, wherein the first conductive winding is configured to be selectively connected to the second conductive winding.

15. The slow wave inductive structure of claim 14, further comprising at least one switch configured to electrically connect the first conductive winding to the second conductive winding.

16. The slow wave inductive structure of claim 14, wherein the first winding is in an inter metal dielectric (IMD) layer over the first substrate, and the second winding is a second IMD layer over the second substrate.

17. The slow wave inductive structure of claim 14, further comprising at least one conductive element electrically connecting the first winding to the second winding, wherein the at least one conductive element comprises a through silicon via (TSV), an inter-level via (ILV), or a metal line.

* * * * *